United States Patent [19]

Trinks et al.

[11] Patent Number: 4,628,817

[45] Date of Patent: Dec. 16, 1986

[54] METHOD OF AND ARRANGEMENT FOR AUTOMATIC ADJUSTMENT OF THE OPERATING MODE OF A SWITCHABLE PRINTING MACHINE

[75] Inventors: Hilmar Trinks; Gunter Peter, both of Radebeul; Volker Eichler, Weinboehla; Winfried Buesse, Radebeul, all of German Democratic Rep.

[73] Assignee: VEB Kombinat Polygraph "Werner Lamberz" Leipzig, Leipzig, German Democratic Rep.

[21] Appl. No.: 772,874

[22] Filed: Sep. 4, 1985

[30] Foreign Application Priority Data

Sep. 5, 1984 [DD] German Democratic Rep. ... 266992

[51] Int. Cl.[4] ..... B41F 21/00; B41F 33/16

[52] U.S. Cl. ..... 101/426; 101/230

[58] Field of Search ..... 101/230, 231, 183, 184, 101/409, 410, 229, 426

[56] References Cited

U.S. PATENT DOCUMENTS

| | | | |
|---|---|---|---|
| 4,120,244 | 10/1978 | Wirz | 101/230 |
| 4,186,662 | 2/1980 | Borneman | 101/230 |
| 4,241,659 | 12/1980 | Fischer | 101/231 |

*Primary Examiner*—J. Reed Fisher

*Attorney, Agent, or Firm*—Michael J. Striker

[57] ABSTRACT

A method of automatically adjusting a printing machine which is selectively operatable in a single-side printing mode and in a two-side printing mode and includes a sheet turning drum, gripper systems and controls therefor, and a ring gear, comprises, during the adjustment from the single-side printing mode to the two-side printing mode and commencing from a first initial position, the succession of steps of adjusting the angular position of the sheet turning drum, adjusting the gripper system controls, and adjusting the angular position of the ring gear, including releasing, angularly displacing, and engaging the ring gear; and during the adjustment from the two-side printing mode to the single-side printing mode and commencing from the first initial position, the succession of steps of adjusting the angular position of the ring gear, including releasing, angularly displacing, and engaging the ring gear, adjusting the gripper systems controls, and adjusting the angular position of the sheet turning drum. The arrangement of the present invention includes various devices which are capable of performing the above method and of issuing various signals including feedback signals, and also of processing such signals in such a manner that, in the event of lack of completion of any step, at least that step is repeated from the beginning.

12 Claims, 7 Drawing Figures

F I G. 6
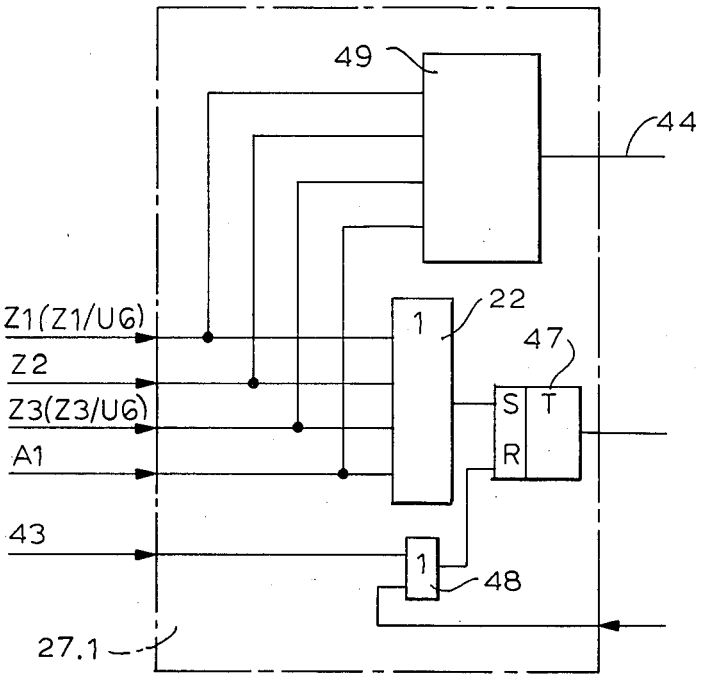
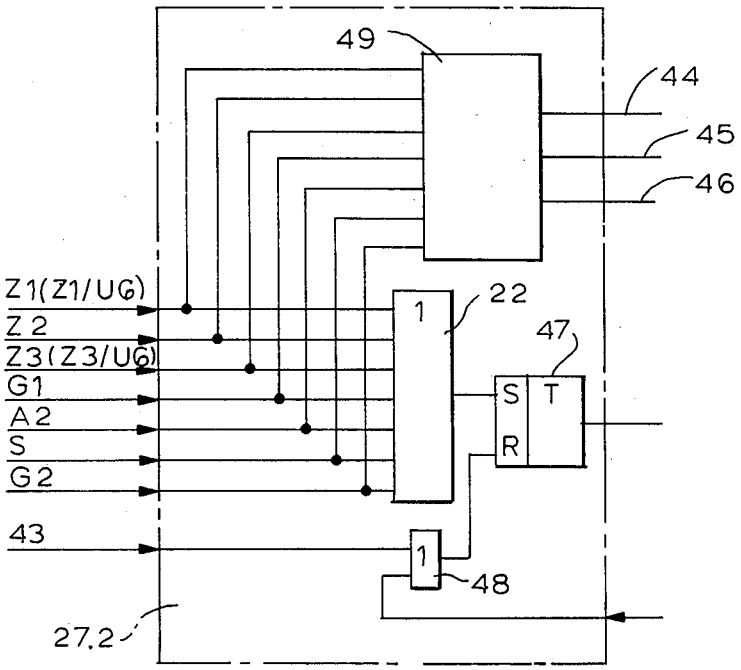
F I G. 7

METHOD OF AND ARRANGEMENT FOR AUTOMATIC ADJUSTMENT OF THE OPERATING MODE OF A SWITCHABLE PRINTING MACHINE

BACKGROUND OF THE INVENTION

The present invention relates to printing machines which are switchable between a single-side printing mode and a two-side printing mode in general, and more particularly to such printing machines in which the sheet being printed upon is turned during the operation in the two-side printing mode in accordance with the principle of trailing sheet edge turning.

In printing machines which are selectively operatable in the single-side printing mode and in the two-side printing mode, also sometimes referred to as a recto printing mode and recto and verso printing mode, the sheet being printed upon is engaged, while operating in the two-side printing mode, by a first gripper system of a sheet guiding or turning cylinder from a preceding cylinder at the tangential zone or nip of such cylinders at the trailing end of the sheet, is transferred to a second gripper system which swings in synchronism with the first gripper system, and then advanced further with the original trailing end forward. During the operation in the single-side printing mode, the sheet is engaged at its leading edge by the second gripper system of the sheet guideing ing or turning cylinder at the aforementioned tangential zone or nip, and then advanced further with its leading edge forward.

In order to enable the gripper systems of the sheet guiding or turning cylinder to engage the sheet being printed upon in one instance at the trailing end of the sheet and in the other instance at the leading edge of the sheet, it is necessary to perform the following adjustment steps during the switching between the two printing modes, that is, during the switching from the two-side printing mode to the single-side printing mode and vice versa:

gripper control (G)

adjustment of the angular positions of the control cams for the control of the movements of the second gripper system of the sheet guiding or turning cylinder, and of the gripper system of the cylinder arranged ahead of the sheet guiding or turning cylinder, in one sense or in the opposite sense, so as to assure an engagement and a release of the sheet being printed upon at different points in time as required by the different operating sequences during the printing in the single-side mode on the one hand, and in the two-side mode, on the other hand. A gripper control device for the centralized positional adjustment of the cams for controlling the gripper systems is known from the German Democratic Republic Pat. No. 155889.

ring gear (Z)

equalization of the phase shift between the part of the machine located upstream of the sheet guiding or turning cylinder and the machine part arranged downstream of such cylinder, in order to assure the engagement of the sheet being printed upon in one instance at the original trailing edge of the sheet and in the other instance at the original leading edge of the sheet. A ring gear control device for the equalization of the phase shift, including the performance of the operating steps of releasing a double gear, angularly displacing the gears and thus the machine parts relative to one another, and reestablishment of the connection of the double gear, is known from the German Democratic Republic Pat. No. 154082.

turning cylinder or drum (S)

release or arresting of the swinging motion of the first and of the second gripper system of the sheet turning cylinder or drum, in order to assure the sheet turning during the operation in the two-side printing mode, or the further transport of the sheet without turning during the operation in the single-side printing mode, as well as the adjustment of a guiding arrangement and selectively rendering a suction control device operative and inoperative, so long as the printing machine achieves the sheet turning by utilizing suction devices. A turning drum control device for the control of the swinging motion of the gripper systems from the operation in the single-side printing mode to the operation in the two-side printing mode, and vice versa, as well as for the performance of the other adjustment operations, is known from the Federal Republic Germany published patent application DE-OS No. 33 31 328.

initial position (A)

certain servicing operations can be accomplished only in certain initial positions of the printing machine. Up to now, the movement of the machine into such initial positions was accomplished by the operating personnel in accordance with the instructions contained in an operation manual.

If the printing machine is switched from the single-side printing mode to the two-side printing mode, and the format of the sheets to be printed upon is to be changed, it is necessary to perform the following operating steps:

achievement of an initial position ring gear adjustment.

Herein, it is disadvantageous that, as a result of the differences in the successions of the operating steps during the switching from the single-side printing mode to the two-side printing mode, on the one hand, and from the two-side printing mode to the single-side printing mode, on the other hand as well as during the format changing operation, and as a result of the fact that certain adjustment operations can be performed only in certain initial positions of the printing machine and certain adjustment operations make it necessary to perform machine movements which are possible only when the elements to be adjusted are in certain positions thereof, the switching between the different printing modes is a difficult, time-consuming, and attention-requiring operation which, upto now, was accomplishable only manually. Obviously, lack of attention on the part of the operating personnel during the switching operation invariably results in machine damage.

SUMMARY OF THE INVENTION

Accordingly, it is a general object of the present invention to avoid the disadvantages of the prior art.

More particularly, it is an object of the present invention to provide an arrangement for controlling the various components of the printing machine in an automatic manner during the switching or adjustment of the printing machine between its operating modes.

Still another object of the present invention is so to construct the arrangement of the type here under consideration as to simplify the switching between the modes.

It is yet another object of the present invention so to design the arrangement of the above type as to be relatively simple in construction, inexpensive to manufacture and install, easy to use, and reliable in operation nevertheless.

A concomitant object of the present invention is to develop a method of automated switching of the printing machine between its various operating modes, which method is simple and easy to implement in the above-mentioned arrangement.

In pursuance of these objects and others which will become apparent hereafter, one feature of the present invention resides in a method of automatically adjusting a printing machine which is selectively operatable in a single-side printing mode and in a two-side printing mode and includes a sheet turning cylinder or drum, gripper systems and controls therefor, and a ring gear, the method comprising, during the adjustment from the single-side printing mode to the two-side printing mode and commencing from a first initial position, the succession of steps of adjusting the angular position of the sheet turning drum,
adjusting the gripper system controls, and
adjusting the angular position of the ring gear, including
  releasing the ring gear,
  angularly displacing the ring gear, and
  engaging the ring gear;

during the adjustment from the two-side printing mode to the single-side printing mode and commencing from the first initial position, the succession of steps of adjusting the angular position of the ring gear, including
  releasing the ring gear,
  angularly displacing the ring gear, and
  engaging the ring gear,
adjusting the gripper system controls, and
adjusting the angular position of the sheet turning drum;

and during the format change, commencing from the first initial position, the step of adjusting the angular position of the ring gear, including
  releasing the ring gear,
  angularly displacing the ring gear, and
  engaging the ring gear.

Advantageously, the method of the present invention further includes, following incomplete performance due to one of power failure and recognition of an error caused by one of non-perfornance and incomplete performance of one of the steps in the region of the step of adjusting the angular position of the ring gear, the step of repeating all of the steps commencing with the following safety step of adjusting the angular position of the ring gear, including releasing the ring gear, angularly displacing the ring gear, and engaging the ring gear.

It is further advantageous when the method further comprises, following the recognition of an error in the region of the step of adjusting the angular position of the sheet turning drum, during the adjustment toward the two-side printing mode, the step of repeating all of the steps commencing with the step of moving to the first initial position, and during the adjustment toward the single-side printing mode, the step of repeating all of the steps commencing with a step of moving to a second initial position.

The present invention also involves an arrangement for performing the above method. According to the present invention, this arrangement for automatically adjusting a printing machine which is selectively operatable in a single-side printing mode and in a two-side printing mode and includes a sheet turning cylinder or drum, gripper systems and controls therefor, and a ring gear, comprises an input device including actuator elements for switching to the single-side printing mode, format change, and switching to the two-side printing mode; a processing device arranged behind the input device and including shift registers and an initial position movement control device including control parts for moving to a first initial position and for moving to a second initial position, a ring gear position adjustment control device including control parts for release, angular displacement and engagement of the ring gear, a gripper control device including control parts for gripper control adjustment in one sense and in the opposite sense, and a sheet turning drum position adjustment device, all arranged behind the processing device; and a feedback evaluation device having inputs connected to the respective feedback outputs of the above-mentioned control devices and outputs connected to the processing device and including a plurality of evaluating groups.

A particularly advantageous construction of the arrangement of the present invention is obtained when the processing device includes a safety shift register including successive bit storage locations Zl, Z2, Z3 and A1 for the operating steps of releasing the ring gear, angularly displacing the ring gear, engaging the ring gear, and moving to the first initial position, a work register constructed as a ring counter and including successive bit storage locations Zl,Z2,Z3,G1, A2, S and G2 for the operating steps of releasing the ring gear, angularly displacing the ring gear, enaging the ring gear, adjusting the gripper system controls in one sense, moving to the second initial position, adjusting the angular position of the sheet turning drum, and adjusting the gripper system controls in the opposite sense; a terminal device connected with the input device, the bit storage locations Z3 and S of the work shift register, and a shifting input of the work register, and an interrupting switch; when the arrangement further comprises an evaluating AND-gate arranged ahead of each shifting input of the shift registers and having two inputs one of which is connected to the interrupting switch and the other of which is connected to an output of an evaluating group included in the evaluation device an operative for evaluating feedback signals of the respective control devices; when outputs of the input device for format change, for switching to the single-side printing mode, and for switching to the two-side printing mode are connected to the input of the bit storage location A1 of the safety shift register; when the outputs of the control device for switching to the single-side printing mode and of the control device for format change are connected, via an OR-gate and a first AND gate whose one input is connected to the output of the bit storage location A1 of the safety shift register, to the bit storage location Z1 of the safety shift register; and when the output of the input device for switching to the two-side printing mode is connected, via a second AND-gate whose one input is connected to the output of the bit storage locations A1 of the safety shift register, to the bit storage location S of the work shift register.

According to an advantageous aspect of the present invention, the above arrangement further comprises a subprogram or subroutine shift register which includes at least one bit storage location that is connected to the output of at least one of the bit storage locations of at least one of the aforementioned shift registers, this subprogram shift register including a shift input connected with the output of an evaluating AND-gate having a plurality of inputs one of which is connected with the interrupting switch and another of which is connected so as to receive another of the feedback signals issued by the control devices that are controlled by the subprogram shift register, the latter further including outputs that are connected with the inputs of the respective control devices.

It is further advantageous when there is further provided a plurality of control elements each of which is associated with one of the bit storage locations of each of the shift registers.

It is also proposed by the present invention for the terminal device to be provided with a first terminal AND-gate having a first input connected to the output of the input device for switching to the single-side printing mode, a second input connected to the output of the bit storage location S of the work shift register, and a third input connected to the shifting input of the work shift register, and an output, a signal light for indicating the reaching of the single-side printing mode position of the machine, connected to the output of the first terminal AND-gate and to a terminal output, a second terminal AND-gate having a first input connected to the shifting input of the work shift register, a second input connected to the output of the bit storage location Z3 of the work shift register, and a third input connected via a terminal OR-gate with the format change output and with the switching to the two-side printing mode output of the input device, and an output, and another signal light for indicating the reaching of the two-side printing mode position of the machine, connected to the output of the second terminal AND-gate and to the terminal output.

According to another facet of the present invention, each of the evaluating groups that is associated with the respective one of the shift registers includes a memory having an input that is connected, via an evaluating AND-gate, with the respective feedback inputs, and an output which is connected with a respective evaluating AND-gate, the memory further having a resetting input which is connected, via a resetting OR-gate and the terminal output, with the terminal device and with the output of the respective evaluating AND-gate.

Advantageously, the evaluating group that is associated with the safety shift register includes an error evaluating circuitry including a plurality of connecting AND-gates and OR-gates which are arranged to evaluate the states of the various feedback outputs of the control devices controlled by the respective associated shift register, and having an output connected with the bit storage location Z1 of the safety shift register and carrying signals representative of errors occuring in the region of the operating step of adjusting the position of the ring gear.

It is also advantageous when the evaluating group which is associated with the work shift register includes an error evaluating circuitry including a plurality of connecting AND-gates and OR-gates which are arranged to evaluate the states of the various feedback outputs of the control devices controlled by the respective associated shift register, and having a first output connected with the bit storage location Z1 of the safety shift register and carrying signals representative of errors occuring in the region of the operating step of adjusting the position of the ring gear , a second output connected with the bit storage location A1 of the safety shift register and carrying signals representative of errors occuring in the region of the operating step of adjusting the position of the sheet turning drum in the direction toward the two-side printing mode position of the machine, and a third output connected with the bit storage location A2 of the work shift register and carrying signals representative of errors occurring in the region of the operating step of adjusting the position of the sheet turning drum in the direction toward the single-side printing mode position of the machine.

Last but not least, it is advantgeous when the arrangement is provided with the above-mentioned subprogram or subroutine shift register, and when the evaluating group which is associated with the subprogram shift register includes an error evaluating circuitry including a plurality of connecting AND-gates and OR-gates which are arranged to evaluate the states of the various feedback outputs of the control devices controlled by the respective associated shift register, and having an output connected with the bit storage location Z1 of the safety shift register and carrying signals representative of errors occuring in the region of the operating step of adjusting the position of the ring gear.

The novel features which are considered as characteristic of the invention are set forth in particular in the appended claims. The improved adjustment control arrangement for a switchable printing machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 6 is a diagram of an evaluating circuitry for a safety shift register; and

FIG. 7 is a diagram of an evaluating circuitry for a work shift register.

DETAILED DESCRIPTION OF THE PREFERRED EMBODIMENT

Figure 1:
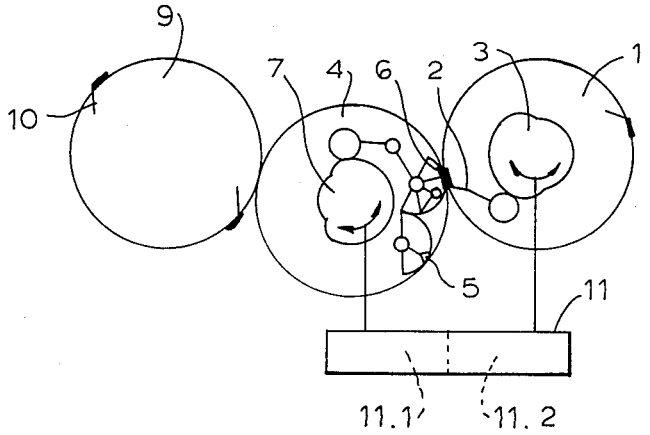
FIG. 1 is a diagrammatic side elevational view of a switchable printing machine in position for singal-side printing.
Figure 2:
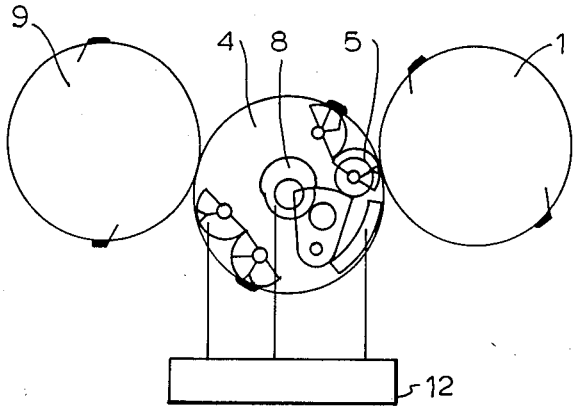
FIG. 2 is a view similar to FIG. 1 but in position for two-side printing.
Figure 3:
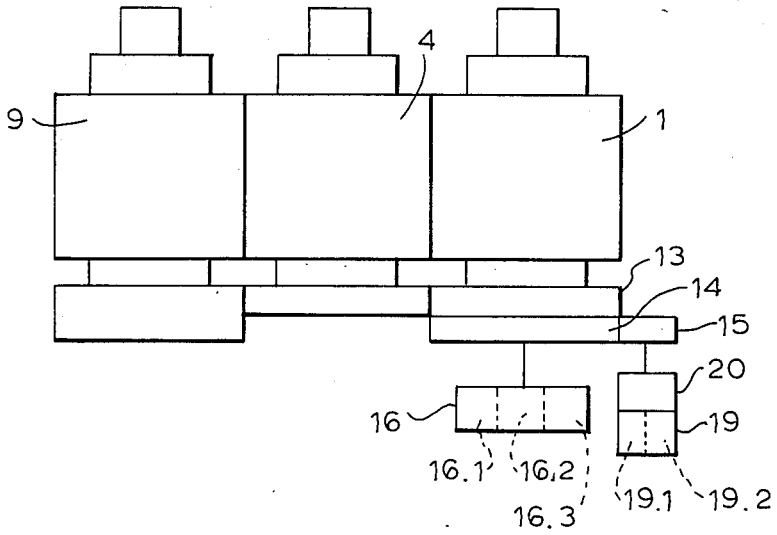
FIG. 3 is a simplified top plan view of the machine.

Referring now to the drawing in detail, and first to FIGS. 1 to 3 thereof, it may be seen that they collectively depict, in a simplified and diagrammatic manner, certain basic components of a printing machine of a known construction which can be selectively operated either in a single-side printing mode, or in a two-side printing mode. Inasmuch as the basic construction of this printing machine is known, it will be discussed below only to the extent necessary for understanding the present invention.

A printing cylinder 1 of a first printing station is provided with a gripper system 2, which is connected to and controlled as to its movement by a gripper cam 3. A sheet turning cylinder 4 is arranged downstream of the printing cylinder 1, as considered in the direction of movement of the sheet being printed upon through the printing machine. The sheet turning cylinder 4 is equipped with a first gripper system 5 and a second gripper system 6. A gripper control cam 7 is provided for the purpose of realization of the opening and closing movements of the first and second gripper systems 5 and 6. A control cam 8 is provided for the purpose of realization of the swinging motion of the first and second gripper systems 5 and 6. Another printing cylinder 9 of a second printing station, which is arranged downstream of the sheet turning cylinder 4, again as considered in the direction of movement of the sheet being printed upon, is also provided with a gripper system, which is identified by the reference numeral 10.

In order to avoid unnecessary cluttering of the drawing, it is shown only in FIG. 1 that the gripper cams 3 and 7 are connected with a gripper control device 11 having a first control part 11.1 operative for the adjustment of the gripper positions and a second control part 11.2 operative for the resetting of the gripper systems into their initial positions, and only in FIG. 2 that the control cam 8 is connected with a sheet turning cylinder control device 12 which is operative for controlling the swinging motion adjustment and, in addition thereto, for controlling the adjustment of a non-illustrated guiding arrangement and for controlling suction. Both the gripper control device 11 and the sheet turning cylinder control device 12 are of known constructions, so that they need not be discussed here in any more detail.

The printing cylinder 1 is equipped with a double gear 13 and 14. At least one of the gears 13 and 14 is constructed as a ring gear, and will be referred to herein as such. One part of the double gear 13 and 14 is connected with the printing cylinder 1, while the remainder of the double gear 13 and 14 is connected, via a driving gear train 15, with a driving motor 20 of the printing machine. The aforementioned one part and remainder of the double gear 13 and 14 are releasably connected with one another and, for the purpose of adjusting the angular position of the one part relative to the remainder of the double gear 13 and 14, are connected with an angular position adjusting device 16 which includes a first control part 16.1 for the release of the ring gear, a second control part 16.2 for the angular displacement of the ring gear, and a third control part 16.3 for the engagement of the ring gear. The driving motor 20 is connected with an initial position control device 19 which includes a first control part 19.1 for movement into a first initial position, and a second control part 19.2 for movement to a second initial position.

Having so described the basic construction of the printing machine, its operation will now be briefly discussed. During the operation in the single-side printing mode, the various components of the printing machine are in their positions shown in FIG. 1 except that, of course, the cylinders 1, 4 and 9 rotate in synchronism about their respective axes. In this case, the sheet being printed upon is transferred, always with its leading edge forward, from one gripper system to another, that is, from the gripper system 2 of the printing cylinder 1 to the gripper system 6 of the sheet turning cylinder 4, and then from the gripper system 6 of the sheet turning cylinder 4 to the gripper system 10 of the second printing cylinder 9. The swinging motion of the gripper systems 5 and 6 is arrested and the respective gripper systems 2 and 6 of the cylinders 1 and 4, and 6 and 10 of the cylinders 4 and 9 are respectively positioned opposite one another at the respective nips of the cylinders 1 and 4, and 4 and 9, at the time of the transfer of the sheet between the gripper systems 2 and 6, and 6 and 10, respectively. At these points, the respective gripper systems 2, 6 and 10 are opened and closed by the respective gripper control cams, such as 3 and 7.

When the printing machine is to operate in the two-side printing mode, the sheet being printed upon is carried, as far as its leading edge is concerned, by the gripper system 2 of the printing cylinder 1 beyond the nip of the cylinders 1 and 4 and the gripper system 5 of the sheet transfer or sheet turning cylinder 4 engages this sheet at its trailing edge. After the performance of swinging motions by the gripper systems 5 and 6, the sheet in question is transferred to the gripper system 6 and from there to the gripper system 10.

As mentioned before, the construction of the printing machine as described so far, as well as the above-discussed operation thereof, are well known. The present invention is to be found in an improvement in the operation machine, which includes, as one of its facets, an operating of the printing method comprising the steps which will be discussed below and which are performed during the switching of the printing machine between the above-mentioned operating modes.

After the commencement of the switching from the single-side printing mode to the two-side printing mode, the printing machine is brought into its first initial position as far as the angular positions of the cylinders 1, 4 and 9 are concerned.

After this first initial position has been reached, the sheet turning cylinder 4 is adjusted as to its angular position in response to a corresponding feedback or position-indicating signal; then, again in response to a corresponding feedback or position-indicating signal, the gripper control is adjusted and, finally, the position of the ring gear is adjusted in response to a corresponding feedback or position-indicating signal by performing the steps of releasing the ring gear, changing the angular position of the ring gear, and engaging or clamping the ring gear, whereafter the completion of the switching operation is indicated.

After the commencement of the switching from the two-side printing mode to the single-side printing mode, the printing machine is first brought into its first initial position as far as the angular positions of the cylinders 1, 4 and 9 are concerned; then, the adjustment of the angular position of the ring gear is accomplished by performing the steps of releasing the ring gear, changing the angular position of the ring gear, and engaging or clamping the ring gear. Thereafter, in response to a corresponding feedback of position-indicating signal, the gripper control is returned back, movement into a second initial position is conducted, and, finally, again in response to a corresponding feedback or position-indicating signal, the sheet turning cylinder 4 is adjusted as to its angular position, whereafter the termination of this particular switching operation is indicated.

After the initiation of a sheet format change operation, the printing machine is first brought into its first initial position as far as the angular positions of the cylinders 1, 4 and 9 are concerned. After this first initial position has been reached, the angular position of the ring gear is adjusted in response to a corresponding feedback or position-indicating signal by performing the steps of releasing the ring gear, changing the angular position of the ring gear, and engaging or clamping the ring gear, while a feedback or position-indicating signal that indicates the reaching of the desired angular position by the ring gear is used for indicating the termination of the format-changing operation.

After electric power failures, and/or after the recognition of errors, as a result of incorrect performance of the operating steps and/or in the event of incorrectly performed operating steps in the region of the operating step for adjustment of the ring gear, inclusive of all of the partial steps constituting the latter, there are performed the safety operating steps constituting the operating step of adjustment of the ring gear, that is, the release of the ring gear, the angular position change of the ring gear, and the engagement of the ring gear, prior to the movement into the first initial position. In the event of occurrence of errors in the performance of other operating steps, commencing with a certain operating step, all following operating steps are repeated. In the event of occurrence of errors in the region of the operating step of adjusting the angular position of the sheet turning cylinder, the operating steps beginning with the operating step of moving into the first initial position are performed again during the switching toward the two-side printing mode, and the steps beginning with the operating step of moving into the second initial position are repeated during the switching toward the single-side printing mode.

Figure 4:
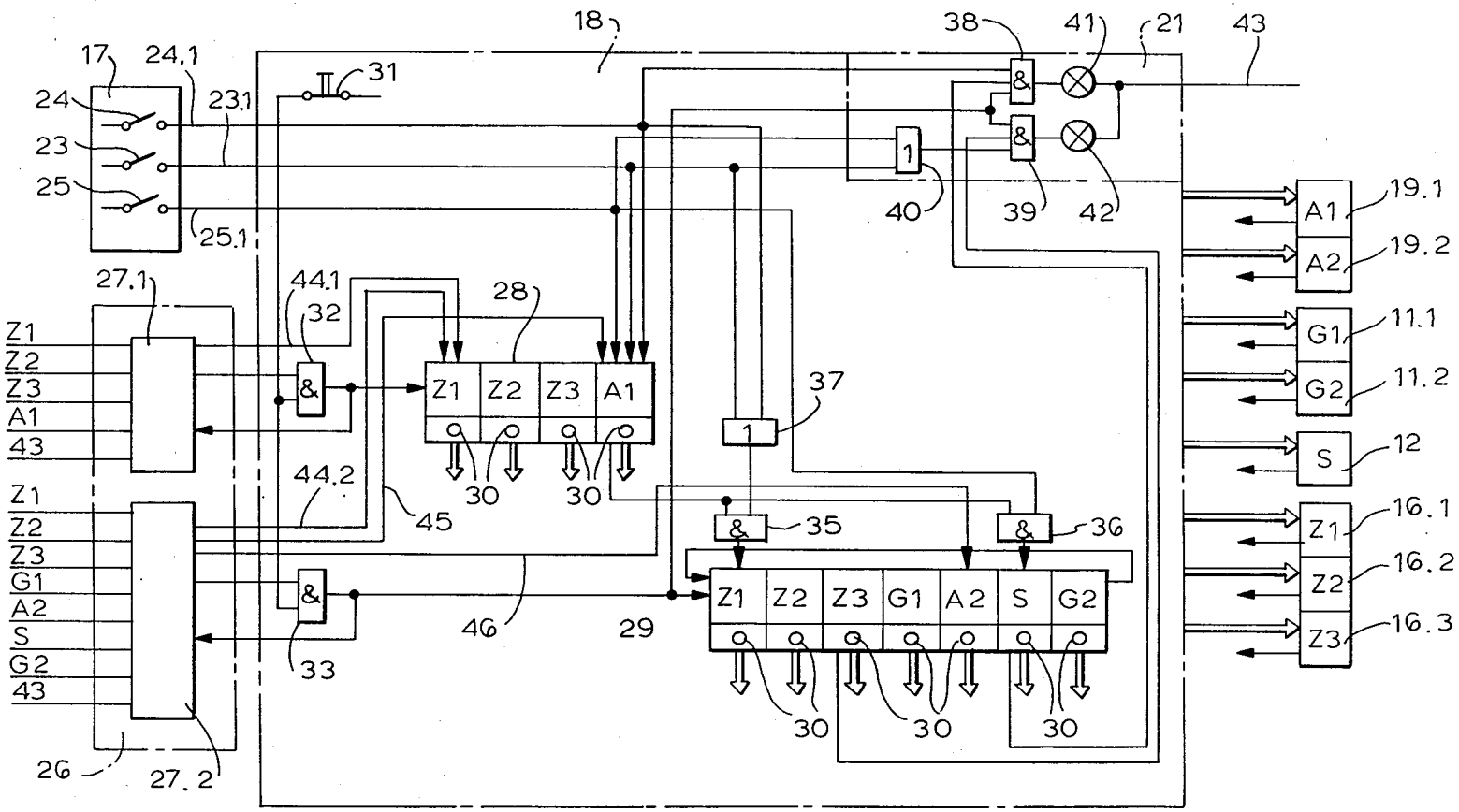
FIG. 4 is a diagrammatic representation of the arrangement of the present invention.

FIG. 4 shows an arrangement according to the present invention for performing the above-discussed operating steps during the various operating-mode switching or changing operations in the desired successions. This arrangement includes an input device 17, a processing device 18, an initial position control device 19 that is connected, via corresponding control elements, with the driving motor 20 of the printing machine, the known ring gear control device 16, the known sheet turning cylinder control device 12, a terminal device 21, and a feedback evaluating device 26 including a plurality of evaluating device groups 27.1 to 27.3.

The input device 17 includes an actuator element 23 for format change, an actuator element 24 for switching to a single-side printing mode, and an actuator element 25 for switching to a two-side printing mode. The actuator elements 23, 25 and 24 of the input device 17 have respective outputs 23.1 for format change, 25.1 for switching to the two-side printing mode, and 24.1 for switching to the single-side printing mode, which carry respective signals and are connected to respective associated inputs of the processing device 18 for format change, for switching to the two-side printing mode, and for switching to the single-side printing mode.

The processing device 18 includes a safety shift register 28 having successive bit storage locations Z1, Z2, Z3 and A1. The respective outputs of the bit storage locations Z1, Z2 and Z3 are respectively connected with the control device parts 16.1, 16. 2 and 16.3 of the ring gear control device 16, while the output of the bit storage location A1 is connected with the first control device part 19.1 of the initial position control device 19. The processing device 18 further includes a work shift register 29 including successive bit storage locations Z1, Z2, Z3, G1, A2, S and G2. Herein, the outputs of the bit storage locations Z1, Z2 and Z3 are again connected with the respective control device parts 16.1, 16.2 and 16.3 of the ring gear control device 16, the outputs of the bit storage locations G1 and G2 are connected with the respective control device parts 11.1 and 11.2 of the gripper control device 11, the output of the bit storage location A2 is connected with the second control device part 19.2 of the initial position control device 19, and the output of the bit storage location S is connected with the sheet turning cylinder control device 12. A control element 30 is associated with each of the bit storage locations of the shift registers 28 and 29.

In addition thereto, the processing device 18 includes an interrupting switch 31 and evaluating AND-gates 32 and 33 which are arranged ahead of the respective shift registers 28 and 29 in the respective shift-controlling outputs thereof. The evaluating AND-gates 32 and 33 have respective first inputs which are connected with the interrupting switch 31 and second inputs which are connected with the respective evaluating device groups 27.1 and 27.2 of the feedback evaluating device 26 which are associated with the respective shift registers 28 and 29.

Finally, the processing device 18 also includes a first AND-gate 35 having two inputs and arranged ahead of the bit storage location Z1 of the work shift register 28, and a second AND-gate 36 having two inputs and arranged ahead of the bit storage location S of the work shift register. An OR-gate 37 is arranged ahead of one of the inputs of the first AND-gate 35 and includes two inputs one of which is connected with the format change output 23.1 and the other of which is connected with the single-side printing output 24.1. The other input of the first AND-gate 35 and one of the inputs of the second AND-gate 36 are connected with the output of the bit storage location A1 of the safety shift register 28. The other input of the second AND-gate 36 is connected with the two-side printing output 25.1.

The input of the bit storage location Z1 of the safety shift register 28 is connected with a first error-indicating output 44.1 of the first evaluating group 27.1 and with a first error-indicating output 44.2 of the second evaluating group 27.2. The input of the bit storage location A1 of the safety shift register 28 is connected with the two-side printing output 25.1, with the format-change output 23.1, with the single-side printing output 24.1 and with a second error-indicating ouptut 45 of the second evaluating group 27.2. A third error-indicating output 46 of the second evaluating group 27 is connected with the bit storage location A2 of the work shift register 29.

The terminal device 21 includes a first terminal AND-gate 38 having three inputs that are respectively connected with the single-side printing output 24.1, with the shift-control input of the work shift register 29, and with the output of the bit storage location S of the work shift register 29, and an output which is connected, via a single-side printing indicator light 41, with a terminal output 43 of the terminal device 21. The terminal device 21 further includes a second terminal AND-gate 39 also having three inputs that are respectively connected with the shift-control input of the work shift register 29, with the output of the bit storage location Z3 of the work shift register 29, and via a preceding terminal OR-gate 40 with the format-change output 23.1 and with the the two-side printing output 25.1, and an output that is connected, via a two-side printing indicator light 42, with the terminal output 43 of the terminal device 21.

As shown in FIGS. 6 and 7, each of the evaluating groups 27.1 and 27.2 includes an evaluating OR-gate 22, a memory 47, an adjustement OR-gate 48 and an error evaluating circuit 49. The evaluating OR-gate 22 and the error evaluating circuit 49 are connected at their inputs with the feedback outputs of the respective output devices which are controlled by the respective shift registers that are arranged behind the respective evaluating group. The error evaluating circuit includes a plurality of AND-gates and OR-gates acting as connecting elements and serving to differentiate between the individual errors which may occur.

A memory 47 is arranged behind the evaluating OR-gate 22 and has an output which is connected with the respective evaluating AND-gate. A resetting OR-gate 48 is arranged ahead of the resetting input of the memory 47 and has a first input which is connected with the terminal output 43 and a second input which is connected with the output of the evaluating AND-gate which is arranged behind the respective memory 47.

The error evaluating circuit 49 of the first evaluating group 27.1 has the first error-indicating output 44.1 which is connected with the bit storage location Z1 of the safety shift register 28. The error evaluating circuit 49 of the second evaluating group 27.2 has the first error-indicating output 44.2 which is connected with the bit storage location Z1 of the safety shift register 28, as well as the second error-indicating output 45 which is connected with the bit storage location A1 of the safety shift register, and the third error-indicating output 46 which is connected with the bit storage location A2 of the work shift register 29. Herein, the first error-indicating output 44.1 or 44.2 carries a signal indicating the occurrence of an error during the performance of the ring gear angular adjustment operation, the second error-indicating output 45 carries a signal indicating the occurrence of an error during the performance of the angular position adjustment operation on the sheet turning cylinder during the switching toward the two-side printing operation, and the third error-indicating output 46 carries a signal indicating the occurrence of an error during the performance of the angular position adjustment operation on the sheet turning cylinder during the switching toward the single-side printing operation.

Figure 5:
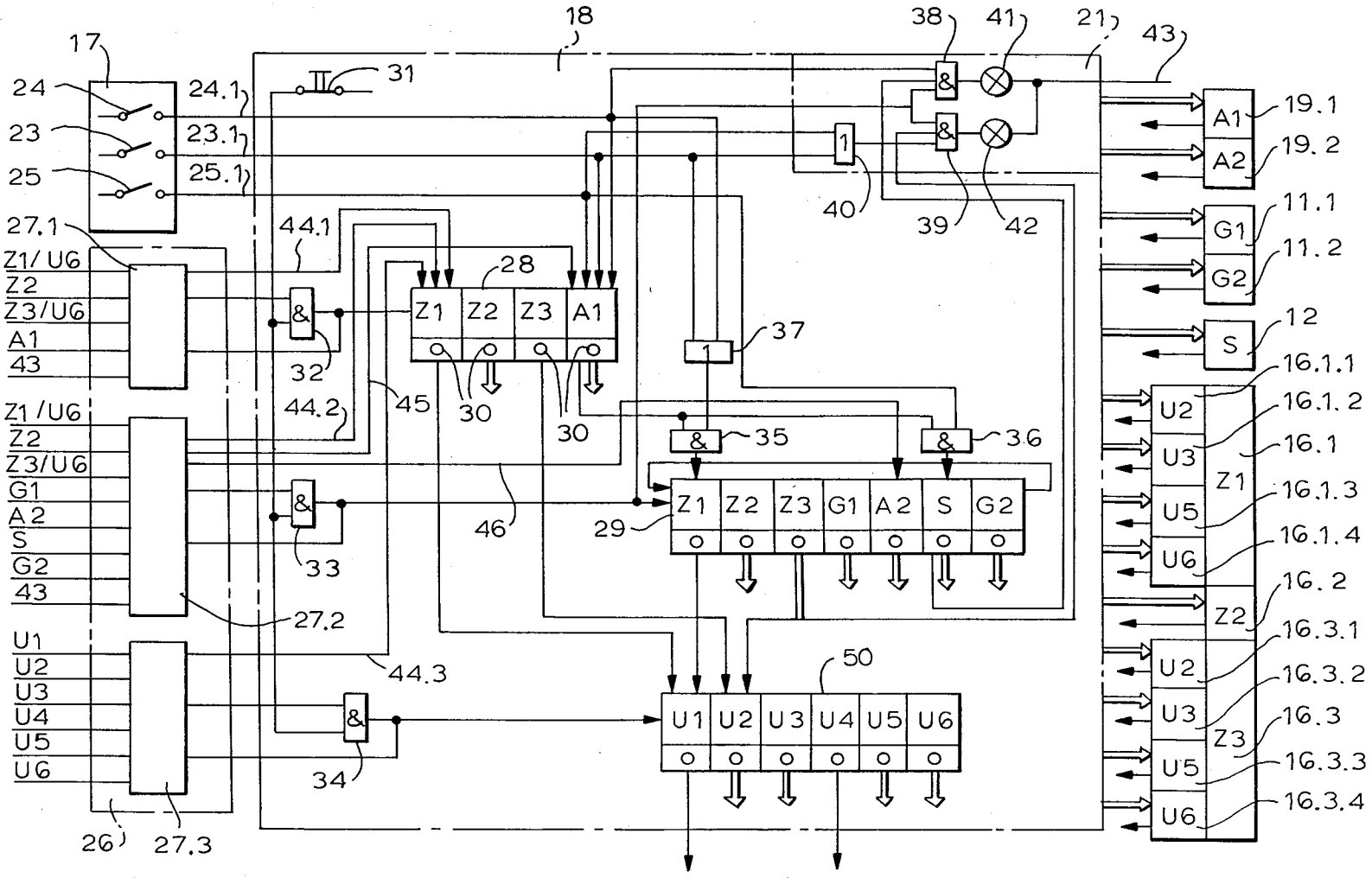
FIG. 5 is a view similar to FIG. 4, with a subprogram.

FIG. 5 illustrates a modified construction of the control arrangement for the performance and control of the switching or changing operation, which incorporates a circuitry embodying a subprogram. This embodiment of the present invention is used when certain operating steps are to be subdivided into operating substeps. In the presented case, the operating step of adjusting the angular position of the ring gear, which includes the steps of releasing the ring gear, changing the angular position of the ring gear, and engaging the ring gear, is subdivided into the following substeps:

time delay U1
couple the adjustment shaft
turn the adjustment shaft during release of the ring gear U3 or
turn the adjustment shaft during engagement of the ring gear
time delay U4
uncouple the adjustment shaft U5
turn the adjustment shaft (remainder turning) during release of the ring gear or
turn the adjustment shaft (remainder turning) during engagement of the ring gear.

To this end, the control device part 16.1 includes a first control subpart 16.1.1 for the performance of the operating substep of coupling of the adjustment shaft, as well as second, third and fourth control subparts 16.1.2, 16.1.3 and 16.1.4 with the correposning feedback outputs for the corresponding operating substeps. Herein, the third control device part 16.3 is constructed analogously to the first control device part 16.1.

In the modified construction of the arrangement of the present invention as depicted in FIG. 5 of the drawing, the processing device 18 includes a subprogram shift register 50 having bit storage locations U1, U2, U3, U4, U5 and U6. The bit storage locations U1 and U4 contain time delay bits, and their outputs constitute the feedback signals supplied to the feedback inputs of the additional evaluating circuit 27.3. The outputs of the bit storage locations U2, U3, U5 and U6 are connected with the corresponding control subparts 16.1.1, 16.3.1, 16.1.2, 16.3.2, 16.1.3, 16.3.3, 16.1.4, and 16.3.4.

The bit storage locations Z1 and Z3 of the safety shift register 28 and of the work shift register 29 are no longer connected with the respective control devices in the manner shown in FIG. 4; rather, the bit storage locations Z1 are connected with the bit storage location U1 of the subprogram shift register 50, and the bit storage locations Z3 are connected with the bit storage location U2 of the subprogram shift register 50.

The additional evaluating group 27.3 is constructed analogously to the first evaluating group 27.1 and is connected via the evaluating AND-gate 34 with the shifting input of the subprogram shift register 50. The error evaluating circuit of the additional or third evaluating group 27.3 has a first error-indicating output 44.3 which is also connected with the bit storage location Z1 of the safety shift register 28.

Now, after the construction of the arrangement of the present invention has been described, its operation will be explained. For the adjustment of the printing machine from the two-side printing mode to the single-side printing mode, the actuator element 24 for the adjustment to the single-side operating mode is actuated. As a result of this, the first control device part 19.1 is put into operation via the contents of the bit storage location A1, and the machine is brought into its first initial position. After the conclusion of this operating step, the memory 47 is set, if no error has been detected, by the feedback signal of the control device part 19.1 via the first evaluating group 27.1 and, in this manner, there is generated a shifting signal. This shifting signal is supplied, if no interruption of the process is performed by the interruption switch 31, to the safety shift register 28 and, thus, the contents of the bit storage location A1 of the safety shift register 28 is shifted into the bit storage location Z1 of the work shift register 29. After the performance of this operating step, and a corresponding feedback, the bit storage locations Z2, Z3, G1, A2 and the bit location S of the work shift register 29 are activated in succession, and thus the entire adjustment is performed. The terminal device 21 is activated via the bit storage location S of the work shift register 29, so that it indicates the termination of the adjustment and resets the memory 47 via the terminal output 43. In this manner, the process is completed.

For the adjustment of the printing machine from the single-side printing mode to the two-side printing mode, the actuator element 25 for the adjustment to the two-side printing mode is actuated. As a result of this, the bit storage location A1 of the safety shift register 28 is activated again at first. After the feedback indicative of the accomplished performance of the operating step, the bit storage locations S, G2, Z1, Z2 and Z3 of the work shift register 29 are activated or addressed in the above-discussed manner and in succession, so that the corresponding operating steps are performed. The terminal device 21 is activated by the contents of the bit storage location Z3 and the adjustment process is completed.

The format change operation is performed in an analogous manner due to the activation of the bit storage location A1 of the safety shift register 28 and subsequently of the bit storage locations Z1, Z2 and Z3 of the work shift register 29 in succession.

The activation of the bit storage locations of the subprogram shift register 50 occurs analogously.

As a result of the presence and action of the control elements 30, there is obtained an indication about which of the bit storage locations of the respective shift register is activated at any given time, so that the performance of the process can be followed by referring to such indications.

The further switching to the next-following bit can be prevented at any arbitrary stage of the process, with the aid of the interrupting switch 31 and, in this manner, the process can be interrupted. The process is then continued after a repeated actuation of the interrupting switch 31.

In the event that an operating step is not performed at all, or is performed only partially, there occurs no feedback to the corresponding control device. After an analysis of the error in the corresponding error evaluating device 49, and establisment that the error had occurred during the performance of one of the operating steps of moving into the first intitial position and positional adjustment of the ring gear, there is generated an error-indicating signal which appears at the first error-indicating output 44. Thereafter, during the repetition of the adjustment process, this process begins again with the operating steps of adjusting the ring gear and movement into the first initial position.

After the electric power failure, the adjustment process is also begun anew also with the safety operating steps, regardless of at what stage the adjustment process was previously interrupted. If the errors are encountered during the performance in the regions of the steps of positional adjustment of the sheet turning cylinder in the direction toward the two-side printing mode, there are repeated, due to the presence of an error-indicating signal at the output 45, the operating steps commencing with the operating step of moving to the first initial position, and if the errors are encountered in the regions of the operating step of positional adjustment of the sheet turning cylinder in the direction toward the single-side printing mode, there are repeated, due to the presence of the error-indicating signal at the output 46, the operating steps commencing with the operating step of moving to the second initial position.

The method of the present invention and the arrangement of the present invention render it possible, for the first time, to perform automatically the switching between the printing modes in switchable single-side and two-side printing machines. As a result, there are obtained the following advantages:

the machine operation (even in the initial position) is possible only after the safety operating steps have been performed and the ring gear is engaged. In this manner, there are avoided machine damages which could otherwise occur during operation with the ring gear released or loose. it is possible to interrupt the adjustment operation and subsequently to resume the same after each of the operating steps by means of acutating a switch, due to the stoppage of a shift register and storage of the continuance pulse. In this manner, the work-preparation and adjustment operations are simplified and damages due to recognizable disruptions are avoided.

if the adjustment movements are performed erroneously during the automatic operation, an automatic stoppage of the operating steps occurs, followed, during the resumption of the operation, by automatic switching to an operating step from which the operating steps can be repeated. In this manner, there is obtained repetition of the operating steps after encountering errors in response to a start signal initiated by the operating personnel.

lucid indication of the operating steps to be performed.

double use of the safety and subprogram shift registers.

renewed performance of the operating steps after the power failure from a preferential initial position, when the most important feedback signals are missing. In this manner, there is avoided the need for providing shift registers for storing the progress of the operating steps upto the point of the power failure.

It will be understood that each of the elements described above, or two or more together, may also find a useful application in other types of arrangements differing from the type described above.

While the invention has been described and illustrated as embodied in a control arrangement for controlling a printing machine capable selectively operating in a single-side and in a two-side printing mode, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and intended to be protected by Letters Patent is set forth in the accompanying claims:

1. A method of automatically adjusting a printing machine which is selectively operatable in a single-side printing mode and in a two-side printing mode, is changeable to different sheet formats, and includes a sheet turning drum, gripper systems and controls therefor, and a ring gear, comprising, during the adjustment from the single-side printing mode to the two-side printing mode and commencing from a first initial position, the succession of steps of adjusting the angular position of the sheet turning drum, adjusting the gripper system controls, and adjusting the angular position of the ring gear, including releasing the ring gear, angularly displacing the ring gear, and engaging the ring gear; during the adjustment from the two-side printing mode to the single-side printing mode and commencing from the first initial position, the succession of steps of adjusting the angular position of the ring gear, including releasing the ring gear, angularly displacing the ring gear, and engaging the ring gear, adjusting the gripper system controls, and adjusting the angular position of the sheet turning drum; and during the format change, commencing from the first initial position, the step of adjusting the angular position of the ring gear, including releasing the ring gear, angularly displacing the ring gear, and engaging the ring gear.

2. The method as defined in claim 1, and further comprising, following incomplete performance due to one of power failure and recognition of an error caused by one of non-performance and incomplete performance of one of said steps in the region of said step of adjusting the angular position of the ring gear, the step of repeating all of said steps commencing with the following safety step of adjusting the angular position of the ring gear, including releasing the ring gear, angularly displacing the ring gear, and engaging the ring gear.

3. The method as defined in claim 1, and further comprising, following recognition of an error in the region of said step of adjusting the angular position of the sheet turning drum, during the adjustment toward the two-side printing mode, the step of repeating all of said steps commencing with a step of moving to the first initial position, and during the adjustment toward the single-side printing mode, the step of repeating all of said steps commencing with a step of moving to a second intitial position.

4. An arrangement for automatically adjusting a printing machine which is selectively operatable in a single-side printing mode and in a two-side printing mode, is changeable to different sheet formats, and includes a sheet turning drum, gripper systems and controls therefor, and a ring gear, comprising an input device including actuator elements for switching to the single-side printing mode, format change, and switching to the two-side printing mode; a processing device arranged behind said input device and including shift registers and an initial movement control device including control parts for moving to a first initial position and for moving to a second initial position; a ring gear position adjustment control device including control parts for release, angular displacement and engagement of the ring gear, a gripper control device including control parts for gripper control adjustment in one sense and in the opposite sense, and a sheet turning drum position adjustment device all arranged behind the processing device; and a feedback evaluation device having inputs connected to respective feedback outputs of the above-mentioned control devices and outputs connected to said processing device and including a plurality of evaluating groups.

5. The arrangement as defined in claim 4, wherein said processing device includes a safety shift register including successive bit storage locations Z1, Z2, Z3 and A1 for the operating steps of releasing the ring gear, angularly displacing the ring gear, engaging the ring gear, and moving to the first initial position, a work shift register constructed as a ring counter and including successive bit storage locations Z1, Z2, Z3, G1, A2, S and G2 for the operating steps of releasing the ring gear, angularly displacing the ring gear, engaging the ring gear, adjusting the gripper system controls in one sense, moving to the second initial position, adjusting the angular position of the sheet turning drum, and adjusting the gripper system controls in the opposite sense; a terminal device connected with the input device, the bit storage locations Z3 and S of the work shift register, and a shifting input of the work shift register, and an interrupting switch; and further comprising an evaluating AND-gate arranged ahead of each shifting input of said shift registers and having two inputs one of which is connected to said interrupting switch and the other of which is connected to an output of an evaluating group included in said evaluation device and operative for evaluating feedback signals of the respective control devices; wherein outputs of the input device for format change, for switching to the single-side printing mode, and for switching to the two-side printing mode are connected to the input of the bit storage location A1 of the safety shift register; wherein the outputs of the control device for switching to the single-side printing mode and of the control device for format change are connected, via an OR-gate and a first AND-gate whose one input is connected to the output of the bit storage location A1 of said safety shift register, to the bit storage location Z1 of the work shift register; and wherein the output of the input device for switching to the two-side printing mode is connected, via a second AND-gate whose one input is connected to the output of the bit storage location A1 of the safety shift register, to the bit storage location S of the work shift register.

6. The arrangement as defined in claim 4; and further comprising a subprogram shift register connected to the output of at least one of said bit storage locations of at least one of said shift registers and including a shift input connected to the output of an evaluating AND-gate having inputs one of which is connected with said interrupting switch and another of which is connected so as to receive another of the feedback signals issued by said control devices that are controlled by said subprogram shift register, said subprogram shift register further including outputs that are connected to the inputs of the respective control devices.

7. The arrangement as defined in claim 4, and further comprising a plurality of control elements each associated with one of said bit storage locations of each of said shift registers.

8. The arrangement as defined in claim 4, wherein said terminal device includes a first terminal AND-gate having a first input connected to the output of the input device for switching to the single-side printing mode, a second input connected to the output of the bit storage location S of the work shift register, and a third input connected to the shifting input of the work shift register, and an output, a signal light for indicating the reaching of the single-side printing mode position of the machine connected to said ouptut of said first terminal AND-gate and to a terminal output, a second terminal AND-gate having a first input connected to the shifting input of the work shift register, a second input connected to the output of the bits storage location Z3 of the work shift register, and a third input connected via a terminal OR-gate with the format change output and with the switching to the two-side printing mode output of the input device, and an output, and another signal light for indicating the reaching of the two-side printing mode position of the machine connected to said output of said second terminal AND-gate and to the terminal output.

9. The arrangement as defined in claim 4, wherein each of said evaluating groups is associated with the respective one of said shift registers and includes a memory having an input that is connected, via an evaluating AND-gate,with the respective feedback inputs and an output which is connected with a respective evaluating AND-gate, the memory further having a resetting input which is connected, via a resetting OR-gate and the terminal output, with the terminal device and with the output of the respective evaluating AND-gate.

10. The arrangement as defined in claim 5, wherein one of the evaluating groups is associated with the safety shift register and includes an error evaluating circuitry including a plurality of connecting AND-gates and OR-gates which are arranged to evaluate the states of the various feedback outputs of the control devices controlled by the respective associated shift register, and having an output connected with the bit storage location Z1 of the safety shift register and carrying signals representative of errors occuring in the region of the operating step of adjusting the position of the ring gear.

11. The arrangement as defined in claim 5, wherein one of the evaluating groups is associated with the work shift register and includes an error evaluating circuitry including a plurality of connecting AND-gates and OR-gates which are arranged to evaluate the states of the various feedback outputs of the control devices controlled by the respective associated shift registers, and having a first output connected with the bit storage location Z1 of the safety shift register and carrying signals representative of errors occuring in the region of the operating step of adjusting the position of the ring gear, a second output connected with the bit storage location A1 of the safety shift register and carrying signals representative of errors occurring in the region of the operating step of adjusting the position of the sheet turning drum in the direction toward the two-side printing mode position of the machine, and a third output connected with the bit storage location A2 of said work shift register and carrying signals representative of errors occuring in the region of the operating step of adjusting the position of the sheet turning drum in the direction toward the single-side printing mode position of the machine.

12. The arrangement as defined in claim 5, further comprising a subprogram shift register; and wherein one of the evaluating groups is associated with the subprogram shift register and includes an error evaluating circuitry including a plurality of connecting AND-gates and OR-gates which are arranged to evaluate the states of the various feedback outputs of the control devices controlled by the respective associated shift register, and having an output connected with the bit storage location Z1 of the safety shift register and carrying signals representative of errors occuring in the region of the operating step of adjusting the position of the ring gear.

* * * * *